US007614166B2

(12) United States Patent
Vick et al.

(10) Patent No.: US 7,614,166 B2
(45) **Date of Patent: *Nov. 10, 2009**

(54) LIGHTED FOOTWEAR

(75) Inventors: T. Kevin Vick, Thomasville, GA (US); Douglas M. Vick, Boston, GA (US); Patrick F. Woolley, II, Rockford, MI (US)

(73) Assignee: Boston Ideas, LLC, Thomasville, GA (US)

( * ) Notice: Subject to any disclaimer, the term of this patent is extended or adjusted under 35 U.S.C. 154(b) by 589 days.

This patent is subject to a terminal disclaimer.

(21) Appl. No.: 11/331,960

(22) Filed: Jan. 13, 2006

(65) Prior Publication Data

US 2006/0230642 A1 Oct. 19, 2006

Related U.S. Application Data

(63) Continuation-in-part of application No. 11/107,123, filed on Apr. 15, 2005, now Pat. No. 7,497,037.

(51) Int. Cl.
*A43B 23/00* (2006.01)
*F21V 21/08* (2006.01)

(52) U.S. Cl. ..... 36/137; 36/132; 362/103

(58) Field of Classification Search ..... 36/137, 36/122, 103, 132; 362/103, 191, 276, 802
See application file for complete search history.

(56) References Cited

U.S. PATENT DOCUMENTS 3,008,038 A 11/1961 Dickens et al.
3,067,322 A 12/1962 Sala
4,324,054 A 4/1982 Rovinsky
4,848,009 A 7/1989 Rodgers
5,237,760 A 8/1993 Altman et al.
5,291,014 A 3/1994 Brede et al.
5,309,145 A 5/1994 Branch et al.
5,381,615 A 1/1995 MacMillan
5,483,759 A 1/1996 Silverman
5,663,614 A 9/1997 Weng et al.
5,800,900 A * 9/1998 Mitchell ..... 428/100
5,821,858 A 10/1998 Stone
5,865,523 A 2/1999 Chien
6,238,076 B1 5/2001 Pascale et al.
6,293,032 B1 9/2001 Waits (Continued)

OTHER PUBLICATIONS

Seattle Gay News Online Article regarding lighted slippers owned by Steven Dunlap, dated May 22, 2003, 2 pages.
Susan A Thorp, "Dunlap Takes Walk in Dark In Pursuit of Fun Slipper" Memphis Commercial Appeal, Jun., 1989, 2 pages.

*Primary Examiner*—Jila M Mohandesi
(74) *Attorney, Agent, or Firm*—Baker Donelson

(57) ABSTRACT

In one embodiment, footwear is provided that includes a sole having a light source disposed therein. A foot sensor, disposed in the sole, detects the presence or absence of a foot in the footwear. A light sensor is adapted to detect the amount of ambient light adjacent the footwear. The footwear may also include an energy storage element for powering the light source and maintaining the light source in the ON state for a period of time after the foot is removed. A selector may be provided for selecting a mode of operation, such as OFF, Auto ON and ON.

In another embodiment, footwear is provided that includes a tag that is removably coupled to the footwear by a hook and loop fastener.

28 Claims, 8 Drawing Sheets

U.S. PATENT DOCUMENTS 6,991,342 B2 1/2006 Gonet
7,057,153 B2 6/2006 Linge et al.
2004/0098884 A1 5/2004 Swan
2004/0103563 A1 6/2004 Linge

* cited by examiner

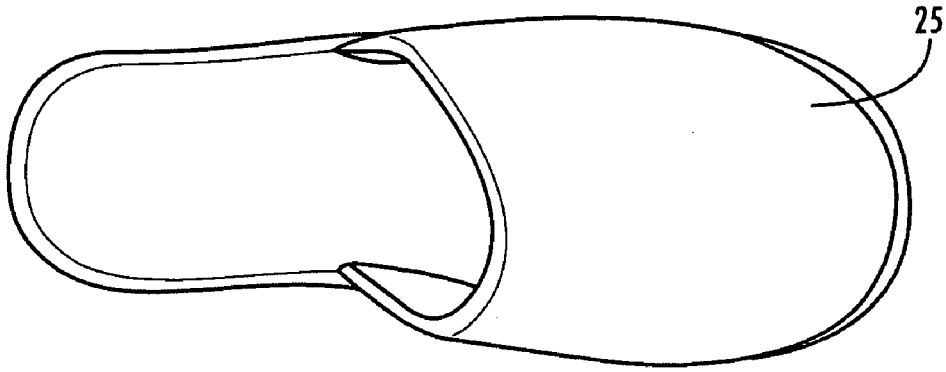
Fig. 6e
Fig. 6f
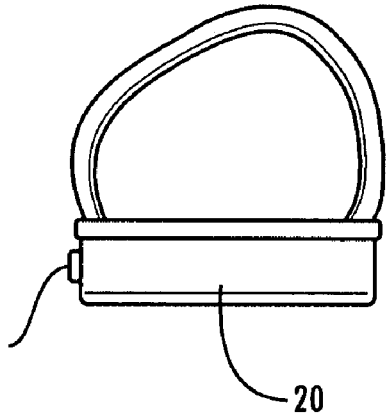
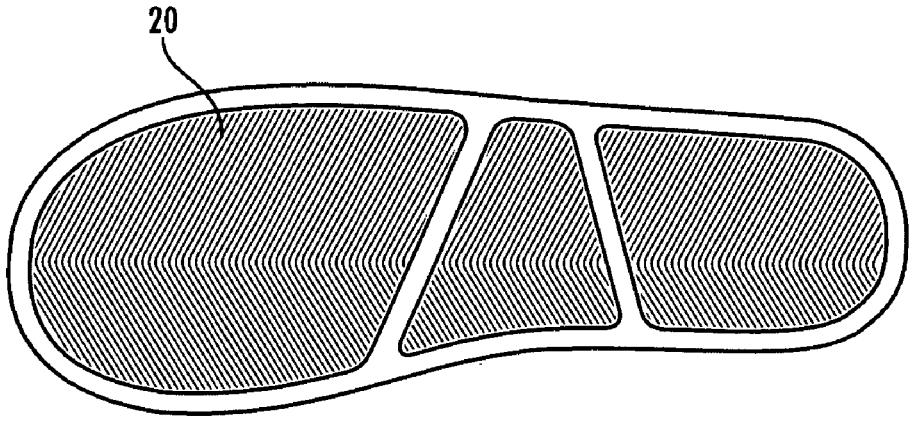
Fig. 6g

LIGHTED FOOTWEAR

CROSS-REFERENCE TO RELATED APPLICATION

This application is a continuation-in-part of U.S. patent application Ser. No. 11/107,123, filed on Apr. 15, 2005, now U.S. Pat. No. 7,497,037 which is assigned to the assignee of the present application.

FIELD OF THE INVENTION

The technology described in this application relates to footwear. In one embodiment, the footwear includes a light source, a light sensor for detecting the amount of ambient light adjacent the footwear and/or circuitry for maintaining the light source in the ON state for a period of time after a user's foot is removed from the footwear. In another embodiment, the footwear includes one of more removable tags that allow for the manufacture of one type of footwear that can be easily and cheaply customized by either the manufacturer, wholesaler, retailer, buyer or user.

BACKGROUND

People must often walk in dark areas, especially at night. Due to the darkness, it is difficult to see objects, such as furniture, toys, balls, etc., in their path. Hitting or tripping over unseen objects can cause injuries. To prevent such injuries, it is desirable to use a light to illuminate the path to be traveled.

It is known to provide a source of illumination on a shoe to overcome the difficulties described above. Some known shoes use a manually operated switch disposed on the exterior of the shoe to control the illumination. Other known shoes include an external heel switch actuated by the pressure of the foot on the floor. In such shoes, the heel switch automatically opens and closes depending on whether the heel is off the floor or on the floor, which results in a flashing shoe light. Still other known shoes include an internal switch that turns a light ON when a foot is in the shoe and turns the light OFF when the foot is removed. See U.S. Pat. No. 3,008,038.

None of the known prior art describes or teaches a construction in which the useful life of a battery controlling a shoe light is extended or how to illuminate an unlighted area once a user's foot is removed from a shoe. Therefore, it is desirable to provide an improved lighted shoe that addresses the deficiencies of the prior art.

It is also desirable to provide footwear, such as a shoe or slipper, that includes a light source and a light sensor adapted to detect the amount of ambient light adjacent the footwear so as to activate the light source only when needed, i.e., when the ambient light is below a predetermined threshold. This extends the battery life of the lighted shoe by disabling the power source when there is sufficient light.

It is desirable to provide footwear that includes a light source and a delay circuit for maintaining the light source in the ON state for a period of time after the foot is removed, allowing time for the footwear user to maneuver in a lighted path before the light is deactivated.

It is also desirable to provide footwear that includes a selector for selecting a mode of operation, such as OFF, Auto ON and ON.

It is desirable to provide footwear that includes a removable tag that allows for the manufacture of one type of footwear that can be easily and cheaply customized by either the manufacturer, wholesaler, retailer, buyer or user.

Thus, a need exists for improved footwear having a lighting construction that enables extended life of the light power source by only activating the light when needed. A need also exists for improved footwear having a lighting construction that provides light even after the foot is removed from the footwear, thereby allowing the wearer time to maneuver before the light is deactivated. Furthermore, a need exists for improved footwear that includes a removable tag for allowing customization of the footwear after manufacture.

SUMMARY

The present invention meets the need in the art by providing footwear comprising a sole having a front and a back, with a light source disposed in the front of the sole and having at least two states (ON and OFF). A power source couples to the light source. A foot sensor disposed in the sole detects the presence a foot in the footwear and operates a switch to cause a control circuitry to activate the power source. The control circuitry maintains the light source in the ON state while the foot sensor detects the presence of a foot in the footwear and delays changing the light source to the OFF state after the foot is removed from the footwear. An energy storage element selected from the group consisting of a capacitor and an inductor, coupled to the control circuitry maintains the light source in the ON state for the delay period of time after the foot is removed from the footwear.

In another embodiment, the footwear of the present invention comprises a sole having a front and a back with a light source, disposed in the front of the sole having at least two states (ON and OFF). A power source couples to the light source. A foot sensor disposed in the sole detects the presence of a foot in the footwear and operates the power. A light sensor disposed in the sole is configured to detect the amount of ambient light adjacent the footwear. A control circuitry configured selectively (a) to disable the light source from operation, (b) to maintain the light source in the ON state while the foot sensor detects the presence of a foot in the footwear and while the amount of ambient light detected is below a threshold light level, and delay changing the light source to the OFF state after the foot is removed from the footwear, and (c) to operate the light source in response to the foot sensor. An energy storage element selected from the group consisting of a capacitor and an inductor, coupled to the control circuitry maintains the light source in the ON state for the delay period of time after the foot is removed from the footwear. A selector for selecting a mode of operation selected from the group consisting of OFF, Auto ON and ON, whereby in the OFF state the control circuitry is disabled from operating notwithstanding the foot sensor detecting the presence of a foot in the footwear, in the Auto ON state the control circuitry is responsive to the foot sensor and the light sensor, and in the ON state the control circuitry is responsive to the foot sensor to operate the light source.

In another aspect, the present invention provides a method of producing footwear comprising the steps of:

- providing a sole having a front and a back;
- installing a light source in the front of the sole;
- installing a foot sensor in the sole so that the foot sensor can detect the presence of a foot in the footwear;
- placing a power supply in the sole for lighting the light source;
- providing control circuitry configured to operate the power supply for lighting the light source while the foot sensor detects the presence of the foot; and
- installing an energy storage element, selected from the group consisting of a capacitor and an inductor, in the sole that is coupled to the control circuitry and that maintains the light source in the ON state for a period of time after the foot is removed from the footwear.

In another aspect of the present invention, the footwear includes a tag that is removably coupled to the shell by a hook and loop fastener, thus allowing the footwear to be easily customized after manufacture.

BRIEF DESCRIPTION OF THE DRAWINGS

FIGS. 6*a-g* show left side, front, right side, perspective, top, back and bottom views, respectively, of one embodiment of the present invention.

FIG. 7 shows an exploded view of footwear according to another embodiment of the present invention.

DETAILED DESCRIPTION

Figure 1:
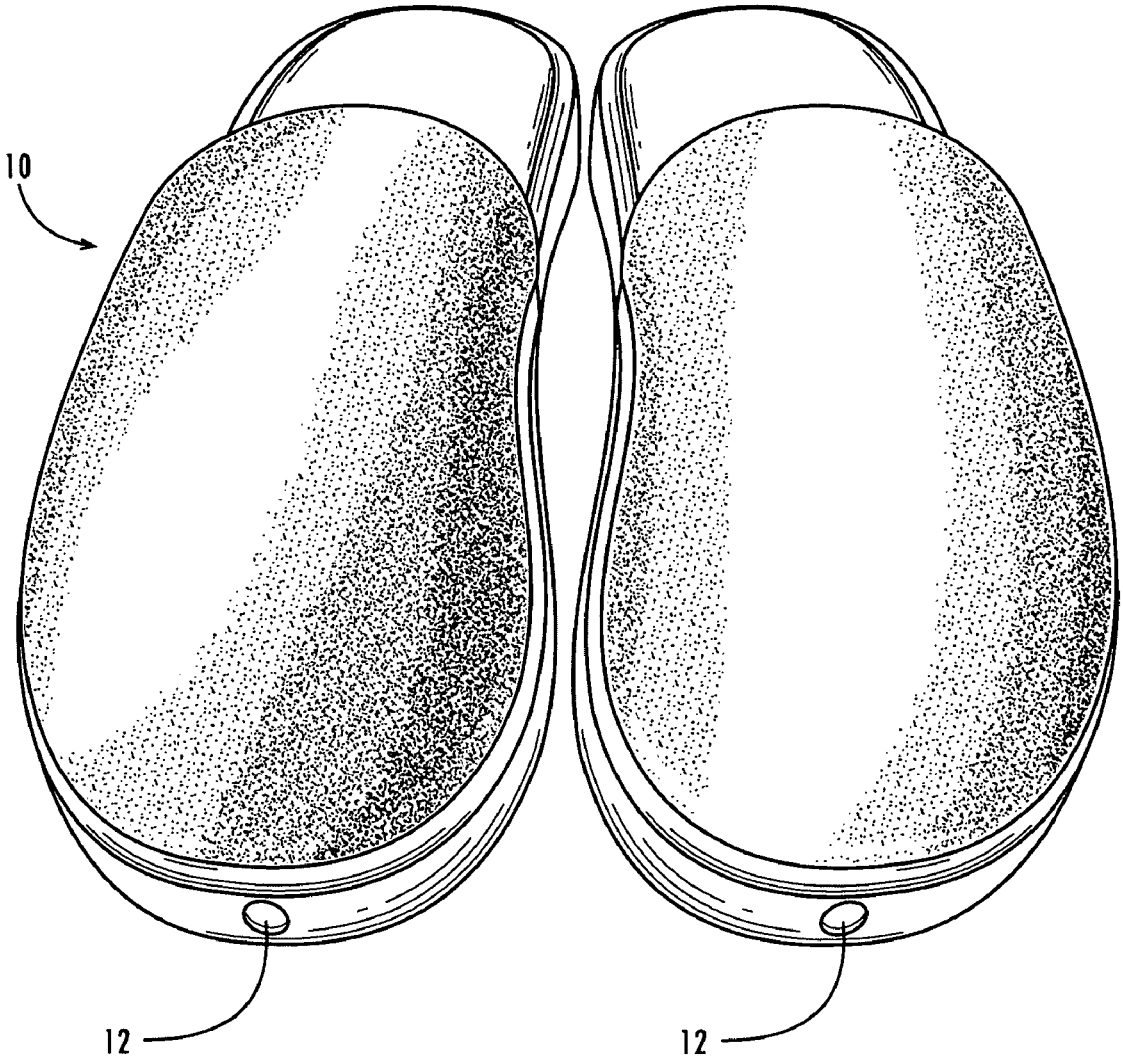
FIG. 1 shows one embodiment of footwear including a light sensor.
Figure 2:
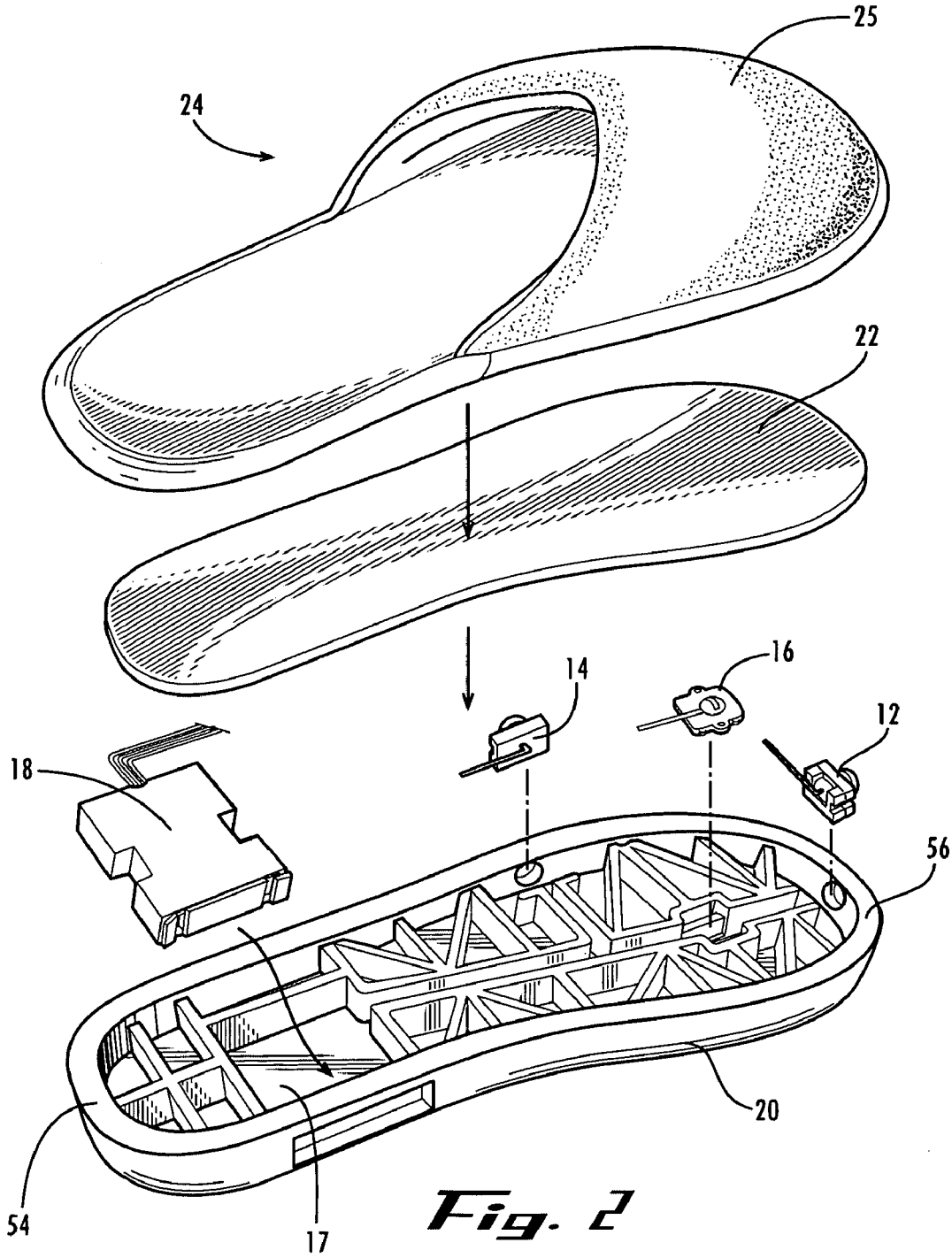
FIG. 2 shows an exploded view of footwear according to one embodiment of the present invention.

The footwear described herein is exemplified by a slipper 10, shown in FIG.1. However, the claimed invention may be embodied in shoes, sandals, boots, or any other type of footwear. In one embodiment, the slipper 10 includes a sole 20, an insole 22 and a shell 24 that includes a foot-covering portion 25, as shown in FIG. 2. In this embodiment, the slipper 10 includes a light source 12, a light sensor 14, a foot sensor 16 and a control mechanism 18. Other embodiments are contemplated that include one or more, but not all, of these elements.

Figure 5:
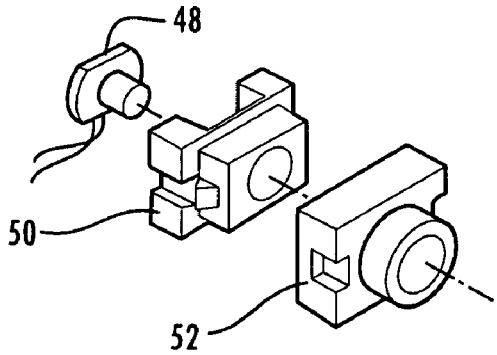
FIG. 5 represents a light source according to one embodiment of the present invention.
Figure 6A:
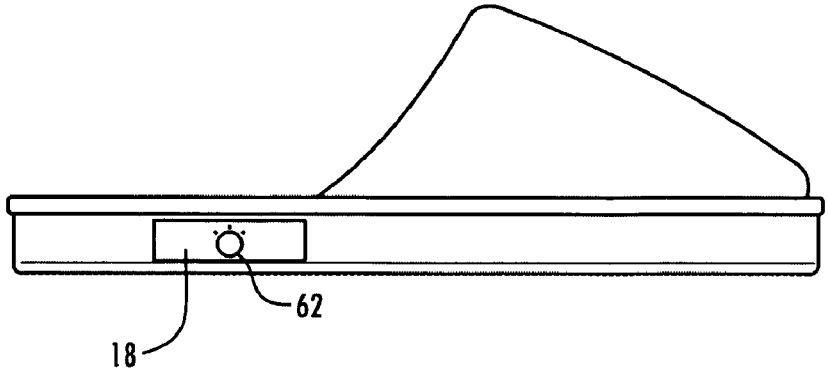
Figure 6B:
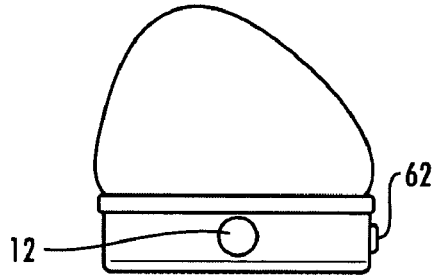
Figure 6C:
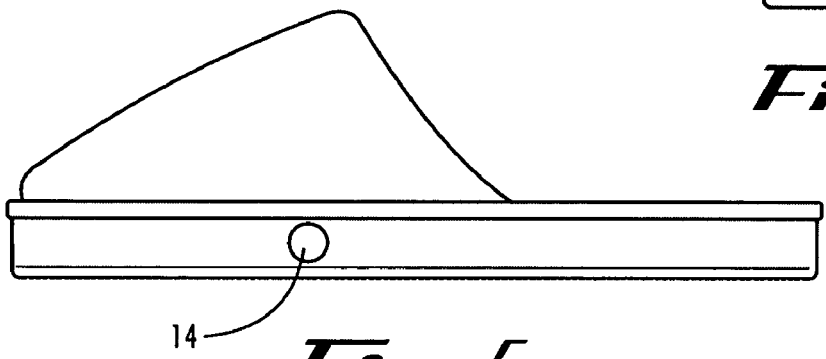
Figure 6D:
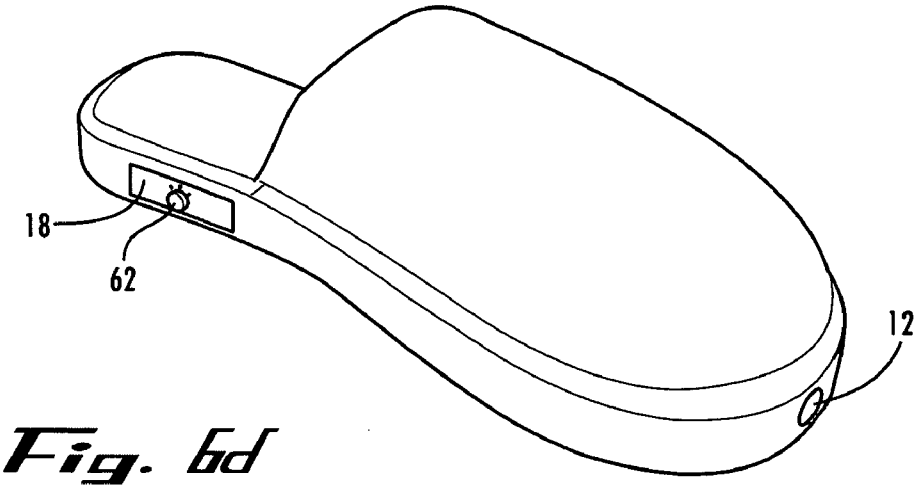
Figure 1:
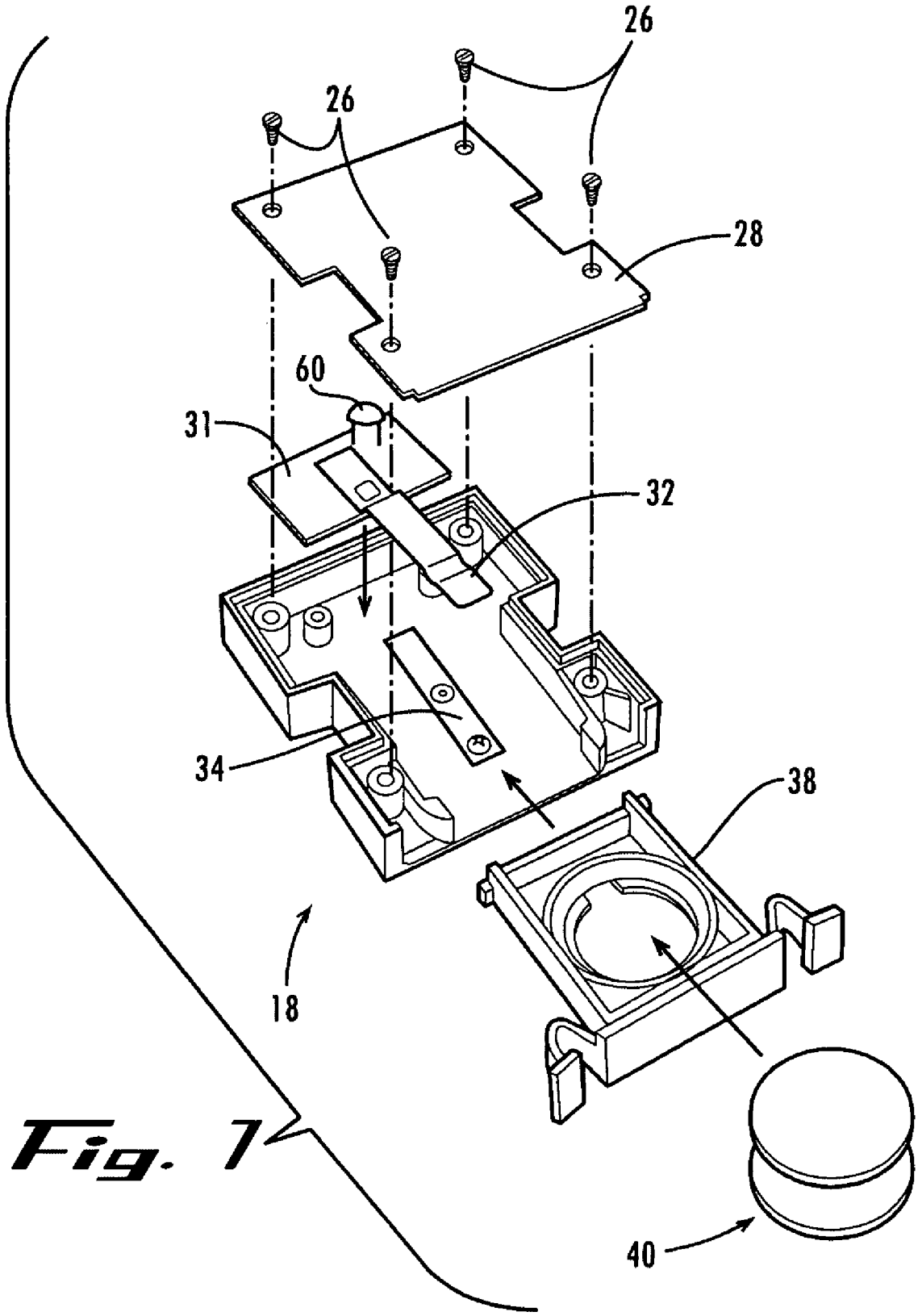

The sole 20 is formed of foam, rubber, plastic or any other suitable material. A light source 12 is mounted in the front portion or toe 56 of the sole 20. The toe 56 includes an aperture that allows light from the light source 12 to shine in front of the slipper 10. In one embodiment, the light source 12 is tilted upward (e.g., at an angle of about 30 degrees with respect to a horizontal plane that intersects the sole) for optimum projection of light. The beam of light extends ahead of the slipper 10 to illuminate the area in front of the slipper 10 so the wearer can safely navigate at night and/or in the dark. The light source 12 has two states (ON and OFF). In one embodiment, the light source 12 is manufactured by M.L.S. ELECTRONICS CO. (model number MCP12) and includes a light emitting diode (LED) 48 (model number PK100), an LED holder 50 (model number PK101A) and an LED lens 52 (model number PK102A), as shown in FIG. 5.

Figure 3:
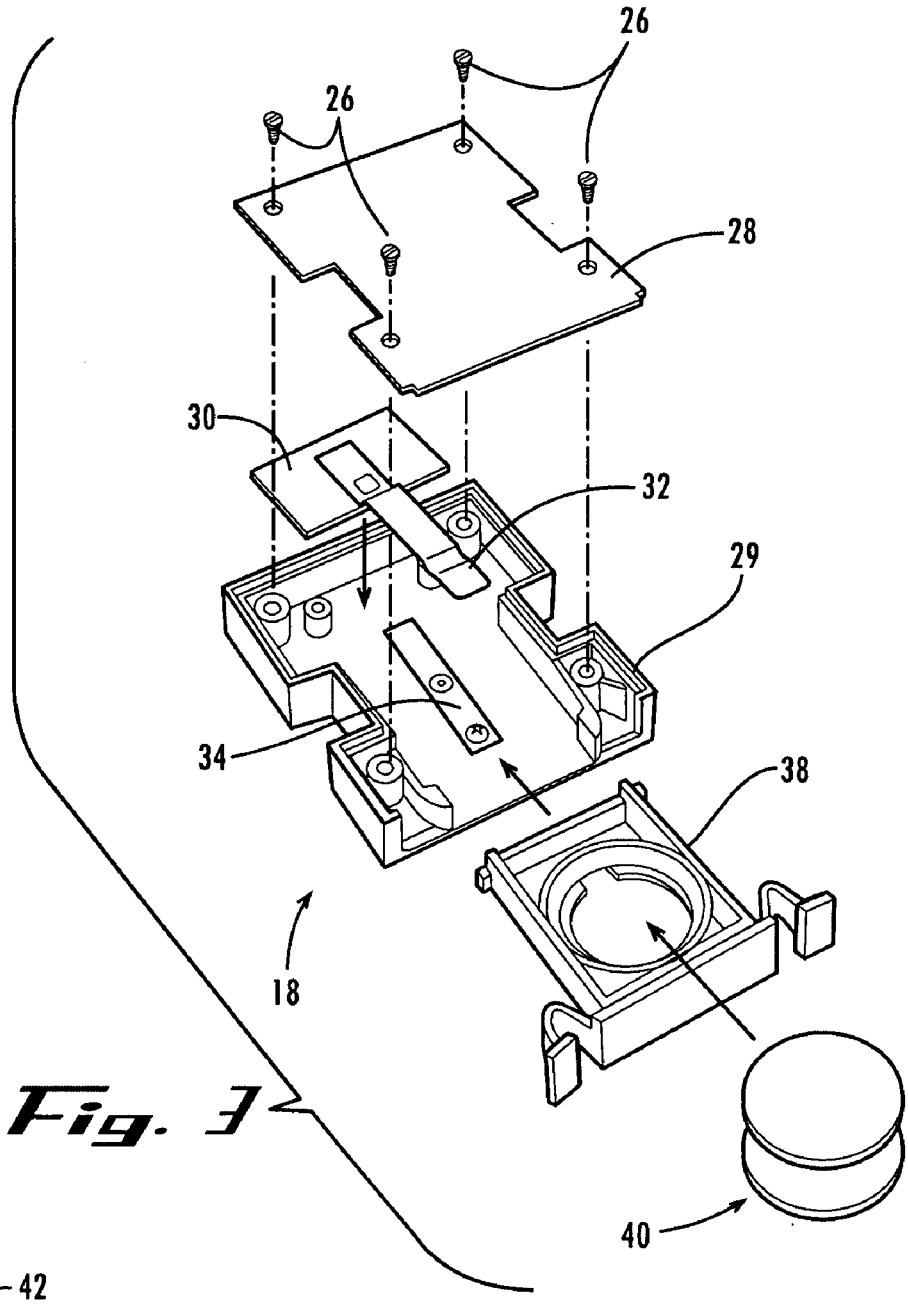
FIG. 3 represents a power source and enclosure according to one embodiment of the present invention.

The sole 20 includes a cavity 17 (preferably disposed in the back portion or heel 54) for housing the control mechanism 18. In one embodiment, the control mechanism 18 is manufactured by EASTAR INDUSTRIES LIMITED (model number MCP10) and includes a power source 40 and control circuitry 30 (model number ES33), as shown in FIG. 3. The control mechanism 18 has a cover 28 that is secured to an enclosure base 29 by screws 26. Contact plates 32 and 34 couple the electrical energy from the power source 40 to the control circuitry 30. One or more wires then couple the electrical energy from the power source 40 to the light source 12, light sensor 14 and/or foot sensor 16. In one embodiment, the power source 40 is a pair of lithium batteries (model number MC212N) that are disposed in a battery holder 38 (model number MC15), both models being manufactured by EASTAR INDUSTRIES LIMITED. In one embodiment, the control mechanism 18 further includes protection circuitry (e.g., a circuit breaker or fuse) that prevents damage to the electronics due to improper insertion of the batteries 40.

The foot sensor 16, mounted in the sole 20, outputs a control signal indicating whether a foot is present or not in the slipper 10. In one embodiment, the output of the foot sensor 16 is coupled to the light source 12. The control signal activates the light source 12 in response to a foot being inserted into the footwear and deactivates it after the foot is removed. In one embodiment, the foot sensor 16 is a contact switch (model number ES6014) manufactured by EASTAR INDUSTRIES LIMITED. Preferably, the switch is disposed in an area of the sole 20 where the foot of a user of the footwear makes good contact with the sole (e.g., under the heel, the ball of the foot or the toes). Alternatively, the foot sensor may include any type of sensor capable of sensing the presence or absence of a foot in the footwear, including a pressure sensor, optical sensor, weight sensor, inductance sensor, capacitance sensor, and the like.

In another embodiment, the control signal from the foot sensor 16 is coupled to control circuitry 30. In this embodiment, control circuitry 30 (model number ES33) includes an integrated circuit (model number ES6115) and a capacitor (model number ES442) manufactured by EASTAR INDUSTRIES LIMITED. However, the control circuitry 30 may include any suitable circuitry, such as an ASIC, a microprocessor, a circuit board, a battery, and the like. Control circuitry 30 determines when to turn the light source ON and OFF given the control signal from the foot sensor 16. Control circuitry 30 then actuates the light source (turns it ON and OFF) accordingly. For example, the control circuitry 30 may delay turning OFF the light source for a predetermined period of time (e.g., 6 seconds) after the foot is removed, allowing the wearer time to safely navigate in a lighted path after removing the footwear.

Figure 4:
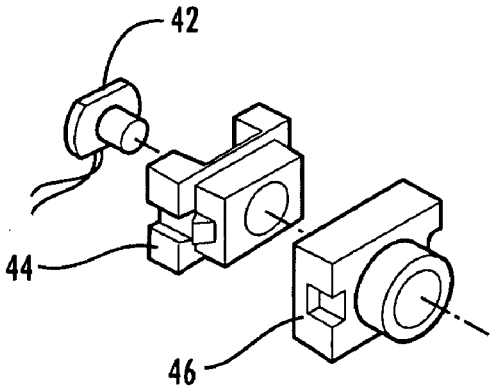
FIG. 4 represents a light sensor according to one embodiment of the present invention.

In a further embodiment, a light sensor 14 is mounted in the sole adjacent an aperture that allows the light sensor 14 to detect the amount of light adjacent the slipper 10, as shown in FIG. 2. In one embodiment, the light sensor 14 is manufactured by SEN TECH COMPANY LIMITED (BRAND: KRC) (model number KR16) and includes a Cadmium Sulfide (CdS) sensor 42 (model number STC551), a sensor holder 44 (model number WT1) and a sensor lens 46 (model number WT2), as shown in FIG. 4. The light sensor 14 outputs a signal indicative of the amount of light sensed. In this embodiment, the output of the light sensor 14 is coupled to control circuitry 30. Control circuitry 30 determines whether to turn the light source ON when a foot is inserted into the footwear by comparing a signal indicative of the amount of light sensed with a threshold. When the sensed light is above the threshold, the light source is disabled (whether a foot is present in the footwear or not). When the sensed light is below the threshold, the light source is activated when a foot is inserted into the footwear. In this way, the battery life of the footwear is extended by not activating the light source when it is not needed, i.e., when there is sufficient ambient light adjacent the footwear.

FIGS. 6*a-g* show left side, front, right side, perspective, top, back and bottom views, respectively, of the slipper 10 according to one embodiment of the invention.

In another embodiment, the control mechanism 18 includes a circuit board 31, an energy storage element 60, and a power source 40, as shown in FIG. 7. The energy storage element 60 powers the light source 12 and maintains the light source in the ON state for a period of time after a foot is removed from the slipper 10. The energy storage element 60 may include, for example, a capacitor or an inductor. The energy storage element 60 has enough stored energy to power the light source 12 for a period of time (e.g., 6-8 seconds) after the foot is removed and the power source 40 is disabled. This delay allows the wearer time to safely navigate in a lighted path after removing the slipper 10.

In a further embodiment, the slipper 10 includes a selector 62 for selecting a mode of operation, such as OFF, Auto ON and ON, as shown in FIGS. 6*a*, 6*b*, 6*d* and 6*f*. The selector 62 may include a switch, a thumb wheel, a dial, a plurality of buttons or other suitable means for selecting an operating mode. The OFF mode includes disabling the light source 12 such that no power is used. In this mode, the footwear functions as normal, non-lighted footwear. The Auto ON mode includes enabling the foot sensor 16 and the light sensor 14. In this mode, the footwear functions as explained above (the light source 12 is activated only when a foot is inserted into the footwear and the sensed light is below a threshold level). The ON mode includes enabling the foot sensor 16 such that the light source 12 goes ON anytime a foot is in the footwear. In one embodiment, the control mechanism 18 maintains the light source in the ON state for a period of time after the foot is removed.

Figure 8A:
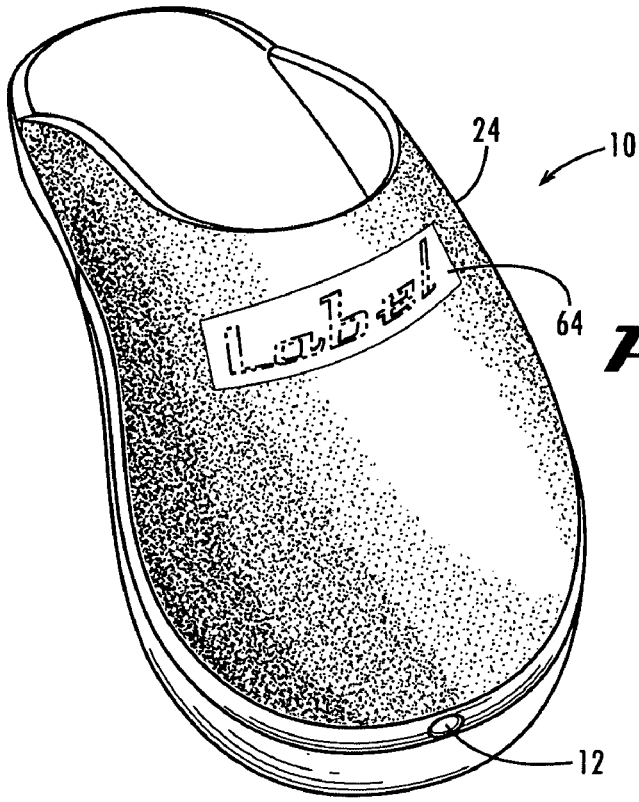
FIGS. 8*a-c* show front views of footwear according to a further embodiment of the present invention.
Figure 8B:
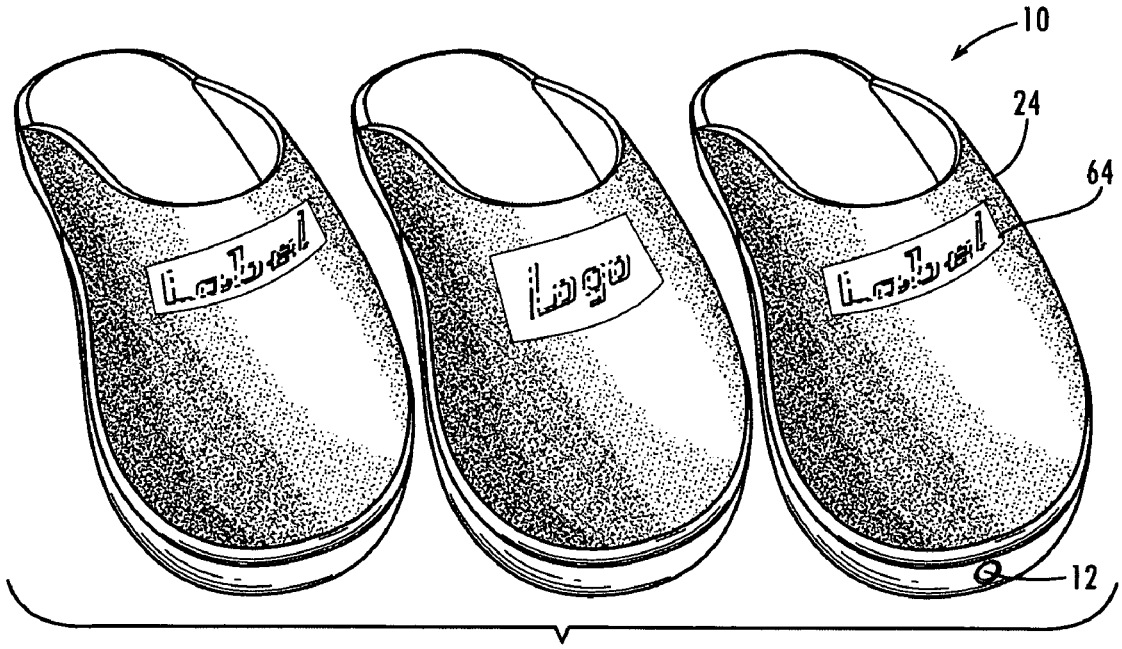
Figure 8C:
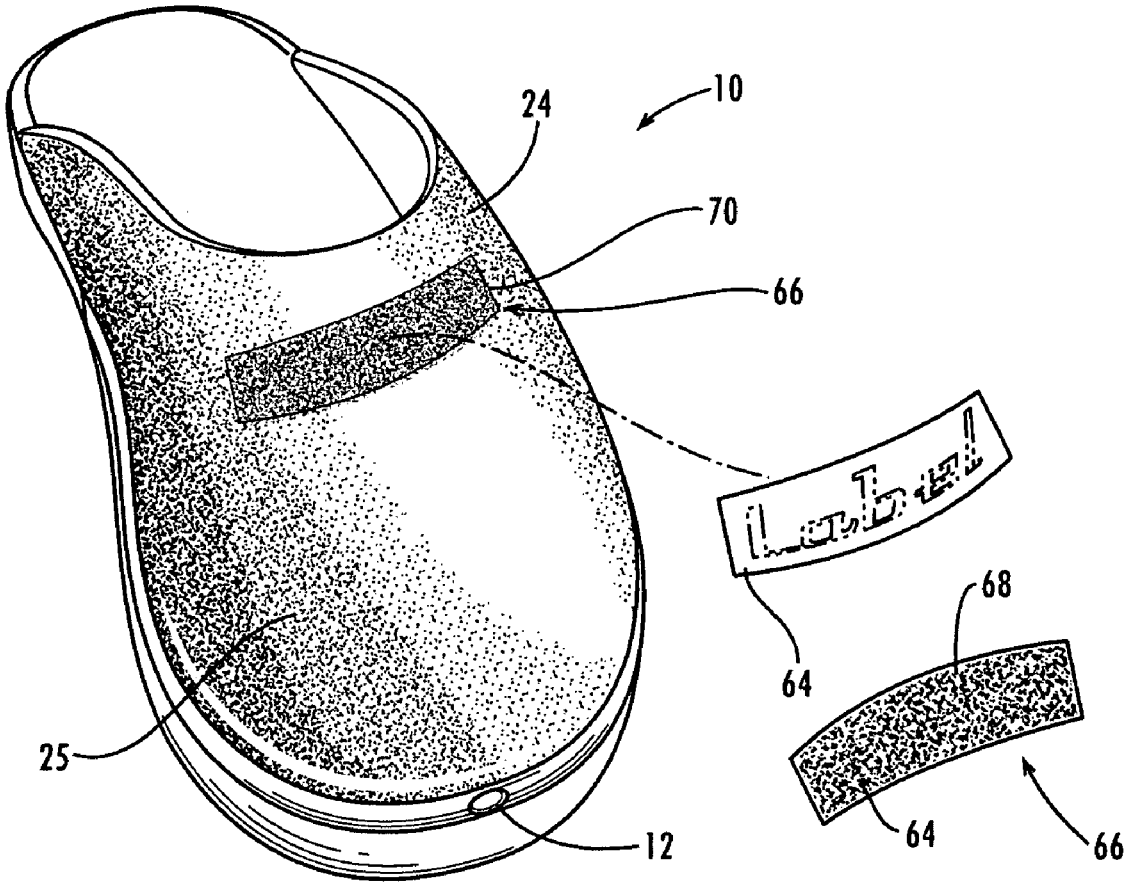

In another embodiment, the slipper 10 includes a tag 64 that is removably coupled to the shell 24 by a hook and loop fastener 66, as shown in FIGS. 8*a*-8*c*. The fastener 66 includes a first portion 68 and a second portion 70; the first portion 68 is coupled to the tag 64, and the second portion 70 is coupled to the shell 24, as shown in FIG. 8*c*. The first portion 68 and the second portion 70 of the hook and loop fastener 66 may be coupled to the tag and shell, respectively, by adhesive, thread, or other suitable means.

One or more tags 64 may be removably attached to the slipper 10 thus allowing the footwear to be easily customized after manufacture. Moreover, the tag concept allows for the manufacture of one type of footwear that can be easily and cheaply customized by either the manufacturer, wholesaler, retailer, buyer or user. For example, the foot-covering portion 25 of the shell 24 may be a tag or may allow for attachment of a tag the size of the foot-covering portion 25. In this way, different colored tags may be attached to the base (e.g., black) footwear. In addition, the tags 64 may be located in more than one area on the footwear. For example, round fasteners could be sewn in several places on the footwear to allow for polka dot tags to be placed on the footwear. The user could choose the color and location of the polka dots.

Also, the tags 64 may include logos, sequins, tassels, balls, jewels, ornamental jewels, beads, animals, cartoons, characters, etc. For example, different NFL team logos could be attached to the footwear before it is sold. In addition, other team logos could be purchased separately to customize the footwear after purchase depending on the sport or season (e.g., NFL tag for fall, MLB tag for spring). The novel tag concept disclosed above can be used on the lighted footwear described herein or any traditional footwear.

The footwear 10 provides several advantages over known footwear, including activating a light source only when needed, extending battery life, allowing time for the wearer of the footwear to safely maneuver in an illuminated path after removing the footwear, providing a selector for selecting a mode of operation, such as OFF, Auto ON and ON, and providing a removable tag for allowing customization of the footwear after manufacture.

Lighted footwear allows the wearer to safely navigate dark areas, which substantially decreases the possibility of injury due to unseen objects. The extended battery life means that the footwear will provide safe illumination longer than previously known lighted shoes. Also, providing footwear that illuminates a path even after the foot is removed provides additional safety over known lighted shoes that turn OFF once the foot is removed.

While particular embodiments of the invention have been shown and described in detail, it will be obvious to those skilled in the art that changes and modifications of the present invention, in its various embodiments, may be made without departing from the spirit and scope of the invention. Other elements, steps, methods and techniques that are insubstantially different from those described herein are also within the scope of the invention. Thus, the scope of the invention should not be limited by the particular embodiments described herein but should be defined by the appended claims and equivalents thereof.

The invention claimed is:

1. Footwear comprising:

a sole having a front and a back;

a light source, disposed in the front of the sole, having at least two states (ON and OFF);

a power source coupled to the light source;

a foot sensor disposed in the sole that detects the presence of a foot in the footwear and operates a switch to cause a control circuitry to activate the power source;

said control circuitry maintains the light source in the ON state while the foot sensor detects the presence of a foot in the footwear and delays changing the light source to the OFF state after the foot is removed from the footwear; and an energy storage element selected from the group consisting of a capacitor and an inductor, coupled to the control circuitry, that maintains the light source in the ON state for the delay period of time after the foot is removed from the footwear.

2. The footwear of claim 1, wherein the power source comprises one or more lithium batteries.

3. The footwear of claim 1, further including a light sensor disposed in the sole and adapted to detect the amount of ambient light adjacent the footwear, the control circuitry operative to change the light source to the ON state upon the light sensor detecting ambient light below a threshold light level.

4. The footwear of claim 3, wherein the light sensor outputs a signal indicative of the amount of light sensed and the control circuitry operative to receive the signal for comparing to the threshold light level.

5. The footwear of claim 1, further including a tag that is removably coupled to the footwear by a hook and loop fastener.

6. The footwear of claim 3, further including a selector for selecting a mode of operation of the control circuitry selected from the group consisting of OFF, Auto ON and ON, whereby in the OFF state, the control circuitry is disabled from operating notwithstanding the foot sensor detecting the presence of a foot in the footwear, in the Auto ON state the control circuitry is responsive to the foot sensor and to the light sensor, and in the ON state the control circuitry operates the light source upon detection of the foot in the footwear.

7. The footwear of claim 3, further including a selector for selecting a mode of operation selected from the group consisting of Auto ON and ON.

8. The footwear of claim 3, further including a selector for selecting a mode of operation selected from the group consisting of OFF and Auto ON.

9. The footwear of claim 1, further including a selector for selecting a mode of operation selected from the group consisting of OFF and ON.

10. Footwear comprising:

a sole having a front and a back;

a light source, disposed in the front of the sole, having at least two states (ON and OFF);

a power source coupled to the light source;

a foot sensor disposed in the sole that detects the presence of a foot in the footwear and operates the power source in response thereto;

a light sensor disposed in the sole and adapted to detect the amount of ambient light adjacent the footwear;

a control circuitry configured selectively (a) to disable the light source from operation, (b) to maintain the light source in the ON state while the foot sensor detects the presence of a foot in the footwear and while the amount of ambient light detected is below a threshold light level, and delay changing the light source to the OFF state after the foot is removed from the footwear, and (c) to operate the light source in response to the foot sensor;

an energy storage element selected from the group consisting of a capacitor and an inductor, coupled to the control circuitry, that maintains the light source in the ON state for the delay period of time after the foot is removed from the footwear; and a selector for selecting a mode of operation selected from the group consisting of OFF, Auto ON and ON, whereby in the OFF state the control circuitry is disabled from operating notwithstanding the foot sensor detecting the presence of a foot in the footwear, in the Auto ON state the control circuitry is responsive to the foot sensor and the light sensor, and in the ON state the control circuitry is responsive to the foot sensor to operate the light source.

11. The footwear of claim 10, wherein the selector is selected from the group consisting of a switch, a thumb wheel, a dial, and a plurality of buttons.

12. The footwear of claim 10, wherein the OFF mode includes disabling the light source.

13. The footwear of claim 10, wherein the Auto ON mode includes enabling the foot sensor and the light sensor.

14. The footwear of claim 10, wherein the ON mode includes enabling the foot sensor.

15. Footwear comprising:

a sole;

a shell disposed over the sole;

a tag removably coupled to the shell by a hook and loop fastener;

a light source, disposed in the sole, having at least two states (ON and OFF);

a power source coupled to the light source;

a foot sensor disposed in the sole that detects the presence of a foot in the footwear;

a light sensor disposed in the sole and adapted to detect the amount of ambient light adjacent the footwear;

a control circuitry configured selectively (a) to disable the light source from operation, (b) to maintain the light source in the ON state while the foot sensor detects the presence of a foot in the footwear and while the amount of ambient light detected is below a threshold light level, and delay changing the light source to the OFF state after the foot is removed from the footwear, and (c) to operate the light source in response to the foot sensor;

an energy storage element selected from the group consisting of a capacitor and an inductor, coupled to the control circuitry, that maintains the light source in the ON state for the delay period of time after the foot is removed from the footwear; and a selector for selecting a mode of operation selected from the group consisting of OFF, Auto ON and ON, whereby in the OFF state the control circuitry is disabled from operating notwithstanding the foot sensor detecting the presence of a foot in the footwear, in the Auto ON state the control circuitry is responsive to the foot sensor and the light sensor, and in the ON state the control circuitry is responsive to the foot sensor to operate the light source.

16. The footwear of claim 15, wherein the hook and loop fastener includes a first portion and a second portion, the first portion of the hook and loop fastener is coupled to the tag, and the second portion of the hook and loop fastener is coupled to the shell.

17. The footwear of claim 15, wherein the first portion and the second portion of the hook and loop fastener are coupled to the tag and shell, respectively, by adhesive.

18. The footwear of claim 15, wherein the first portion and the second portion of the hook and loop fastener are coupled to the tag and shell, respectively, by thread.

19. The footwear of claim 15, wherein the tag is selected from the group consisting of a logo, a polka dot, a sequin, a tassel, a ball, a jewel, a bead, an animal, a cartoon, and a character.

20. The footwear of claim 15, wherein the footwear is selected from the group consisting of a slipper, a shoe, a sandal, and a boot.

21. A method of producing footwear comprising the steps of:

providing a sole having a front and a back;

installing a light source in the front of the sole;

installing a foot sensor in the sole so that the foot sensor can detect the presence of a foot in the footwear;

placing a power supply in the sole for lighting the light source;

providing control circuitry configured to operate the power supply for lighting the light source while the foot sensor detects the presence of the foot; and installing an energy storage element selected from the group consisting of a capacitor and an inductor in the sole that is coupled to the control circuitry and that maintains the light source in the ON state for a period of time after the foot is removed from the footwear.

22. The method of claim 21, further comprising installing a light sensor in the sole that is adapted to detect the amount of ambient light adjacent the footwear and wherein the control circuitry is configured to operate the light source while the light sensor detects ambient light that is below a selected threshold and the foot sensor detects the presence of the foot.

23. The method of claim 22, further including installing a selector in the footwear for selecting a mode of operation of the control circuitry selected from the group consisting of OFF, Auto ON and ON, whereby in the OFF state the control circuitry is disabled from operating notwithstanding the foot sensor detecting the presence of a foot in the footwear, in the Auto ON state the control circuitry is responsive to the foot sensor and the light sensor, and in the ON state the control circuitry is responsive to the foot sensor to operate the light source.

24. The method of claim 21, wherein the selector is selected from the group consisting of a switch, a thumb wheel, a dial, and a plurality of buttons.

25. The method of claim 21, further including providing a tag that is removably coupled to the footwear by a hook and loop fastener.

26. The method of claim 25, further including coupling the hook and loop fastener to the footwear by adhesive.

27. The method of claim 25, further including coupling the hook and loop fastener to the footwear by thread.

28. The method of claim 21, wherein the foot sensor is selected from the group consisting of a switch, a contact switch, a pressure sensor, an optical sensor, a weight sensor, an inductance sensor, and a capacitance sensor.

* * * * *